US005602072A

United States Patent [19]

Hutt et al.

[11] Patent Number: 5,602,072

[45] Date of Patent: Feb. 11, 1997

[54] THERMAL TRANSFER PRINTING DYE SHEET

[75] Inventors: Kenneth W. Hutt, Nr Manningtree; Ian R. Stephenson, St. Andrews, both of England

[73] Assignee: Imperial Chemical Industries PLC, United Kingdom

[21] Appl. No.: 347,321

[22] Filed: Jan. 26, 1995

[30] Foreign Application Priority Data

Apr. 2, 1993 [GB] United Kingdom ..... 9307082

[51] Int. Cl.[6] ..... B41M 5/035; B41M 5/38

[52] U.S. Cl. ..... 503/227; 428/195; 428/209; 428/913; 428/914; 430/945

[58] Field of Search ..... 8/471; 428/195, 428/323, 913, 914, 209; 430/200, 201, 945; 503/227

[56] References Cited

U.S. PATENT DOCUMENTS 5,244,770 9/1993 De Boer et al. ..... 430/200

5,360,781 11/1994 Leenders et al. ..... 503/227

OTHER PUBLICATIONS

Patent Abstract of Japan vol. 10, No. 115 (M–474) (2172) 30 Apr. 1986 & JP A 60 244 598 (Fuji Kagaku Shikougiyou K.K.) 4 Dec. 1985.

Patent Abstract of Japan vol. 11, No. 175 (M–596) (2622) 5 Jun. 1987 & JP A 62 007 590 (Nippon Kogaku K.K.) 14 Jan. 1987.

Patent Abstract of Japan vol. 4, No. 4 (E–164) 12 Jan. 1980 & JP A 54 143 152 (Tokyo Shibaura Kenki K.K.) 11 Aug. 1979.

*Primary Examiner*—B. Hamilton Hess

[57] ABSTRACT

A dye sheet for light induced thermal printing of images onto a transparent receiver sheet, with a reflective layer positioned such that laser light projected through the receiver sheet and not absorbed on the first pass through the dye sheet is reflected back so as to be absorbed on a second pass, is disclosed. An assembly for light induced thermal printing and a method of thermal printing are also disclosed.

10 Claims, 1 Drawing Sheet

THERMAL TRANSFER PRINTING DYE SHEET

This invention relates to light-induced thermal printing and particularly to dye sheets therefor.

Thermal transfer printing is a generic term for processes in which one or more thermally transferable dyes are caused to transfer from a dye sheet to a receiver sheet in response to thermal stimuli. Using a dye sheet comprising a thin substrate supporting a dye coat containing one or more such dyes uniformly spread over an entire printing area of the dye sheet, printing can be effected by heating selected discrete areas of the dye sheet whilst the dye coat is pressed against a receiver sheet, thereby causing dye to transfer to corresponding areas of that receiver sheet. The shape of the pattern transferred is determined by the number and location of the discrete areas which are subject to heating. Full colour prints can be produced by printing with different coloured dye coats sequentially in like manner and the different coloured dye coats are usually provided as discrete uniform print-size areas in a repeated sequence along the same dye sheet.

A typical receiver sheet comprises a substrate supporting a receiver coat of a dye-receptive composition containing a material having an affinity for the dye molecules, and into which they can readily diffuse when the adjacent area of dye sheet is heated during printing. Such receiver coats are generally 2–6 μm thick, and examples of suitable materials with good dye-affinity include saturated polyesters soluble in common solvents to enable them readily to be applied to the substrate as coating compositions, and then dried to form the receiver coat.

For efficient dye transfer, both the dye coat and the receiver coat need to be heated and therefore, ideally, the maximum heat should be generated at the interface between the dye coat and the receiver coat. In conventional thermal printing using a printing head, the heat is applied to the face of the dye sheet remote from the dye coat and hence dye transfer relies on the conduction of the heat through the dye sheet which inherently limits the sensitivity, ie. the Optical Density (OD) of the final image that can be achieved for a given energy input.

Recent developments have shown that the use of a laser as the energy source can improve the sensitivity as well as providing much higher resolution.

As is well known, the use of a laser requires that there is effective conversion of the light energy to thermal energy. Whilst in principle this conversion could be effected by the dyes themselves, in practice it is more usual, and indeed sometimes essential, to include a separate absorber material in the dye sheet. This is particularly necessary if the laser emits infra-red light. The material may be a broad band absorber such as carbon black or may be a narrow band absorber such as a metal phthalocyanine which may be selected to absorb only in the region of the laser being used.

The absorber material may be located in the dye coat or in a separate layer underneath the dye coat. Both locations mean that the heat is generated in a more appropriate position than when a print head is used. However, there is still room for improvement as there is a limit to the amount of separate absorber material that can be accommodated in the dye coat without affecting the amount of dye available for transfer and having the absorber material in a separate layer means that the conduction factor, although reduced, is still present.

Co-pending application No. 9219237.6 discloses that further improvements in sensitivity can be obtained by incorporating absorber material in the receiver sheet as well as the dye sheet enabling heat to be generated on both sides of the interface.

EPA 483789 discloses that sensitivity improvements can be effected in an alternative manner by the use of a receiver sheet which incorporates a reflective layer. However, the use to which the receiver sheet is put in this disclosure is as an intermediate stage in colour pre-press proofing, ie the image is transferred from the receiver sheet to a further substrate, which is usually paper, to simulate the final printed image. Hence the appearance and other properties of the receiver sheet are of little importance.

Clearly, no such reflective layer can be present when the receiver sheet is itself transparent as is the case in the preparation of, for example, a 35 mm slide or an overhead for projection.

Figure 1:
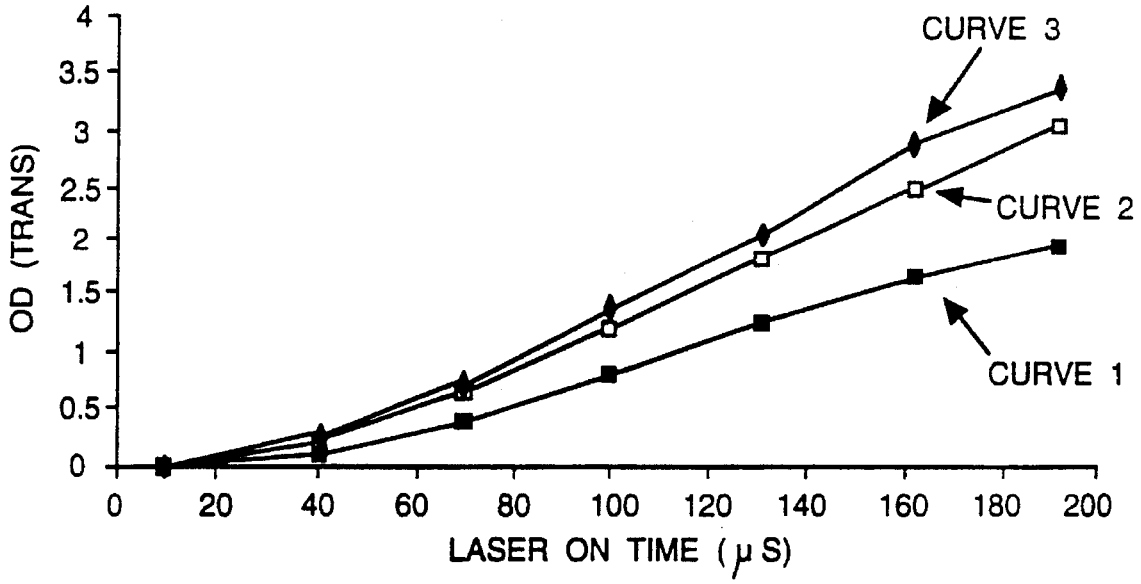
FIGS. 1 and 2 show the results in terms of optical density against laser on time for three combinations of receiver sheets and dye sheets as shown by Curves 1, 2, and 3.

According to one aspect of the present invention, there is provided a dye sheet for light induced thermal printing characterised by the provision of a reflective layer positioned such that laser light projected through the receiver sheet and not absorbed on the first pass through the dye sheet is reflected back so as be to absorbed on a second pass. According to a further aspect of the invention, there is provided an assembly for light induced thermal printing comprising a dye sheet comprising a substrate supporting a dye coat containing one or more thermally transferable dyes and a transparent receiver sheet comprising a substrate supporting a receiver coat containing a material having an affinity for dye molecules, characterised in that the dye sheet has a reflective layer positioned such that when the dye sheet and the receiver sheet are pressed together, laser light projected through the receiver sheet into the dye sheet and not absorbed by the first pass through the dye coat is absorbed on a second pass. Preferably, the receiver sheet contains absorber material, which may be a broad band absorber such as carbon black or may be a narrow band absorber such as a metal phthalocyanine.

Such a dye sheet is, of course, not suitable for a more conventional type of printing system in which the laser is projected through the dye sheet.

The reflective layer may be provided on either surface of the substrate. However, when on the front surface, ie between the substrate and the dye coat, the reflective layer acts as a barrier to prevent diffusion of dye into the substrate.

In some circumstances, it may not be convenient or possible to incorporate a reflective layer in the dye sheet and as mentioned above it is not possible to incorporate it in a transparent receiver sheet.

According to a further aspect of the invention there is provided a method of light induced thermal printing in which a transparent receiver sheet, during imaging by a laser through the dye sheet, is positioned against a surface having a reflective layer.

Such surface could take the form of a mirrored platen roller around which the receiver sheet is tensioned.

The reflective layer should have a reflectance at the wavelength of the laser light of at least 15 and preferably 50%.

The layer may be formed of any suitably reflective material, metals being particularly suitable with aluminium being preferred to others on the basis of cost, and may be applied by conventional means such as vapour deposition or sputtering.

The invention will be more readily understood from the following examples.

EXAMPLE 1

Dye coat and receiver coat solutions were made up according to the following formulations:

| Dye coat | | Receiver coat | |
|---|---|---|---|
| Magenta dye | 0.833 g | Vylon 103 | 12.04 g |
| Absorber material | 0.197 g | Vylon 200 | 5.175 g |
| PVB BX1 | 0.444 g | Tinuvin 234 | 0.19 g |
| ECT 10 | 0.111 g | Ketjenflex MH | 1.39 g |
| THF | 11.1 g | Cymel 303 | 1.12 g |
| | | Tegomer | 0.13 g |
| | | R4046 | 0.067 g |
| | | THF | 128.9 g |

(The absorber material is hexadeca-β-thionaphthalene copper(II) phthalocyanine, PVB BX1 is polyvinylbutyral from Hercules, ECT 10 is ethyl cellulose from Sekisui, THF is tetrahydrofuran, Vylon 103 and 200 are high dye affinity polyesters from Toyobo, Tinuvin 234 is a UV absorber from Ciba-Geigy, Ketjenflex MH is toluenesulphonamide/formaldehyde condensate from Akzo, Cymel 303 is a hexamethoxymethylmelamine oligomeric crosslinking agent from American Cyanamid, Tegomer is a bis-hydroxyyalkylpolydimethylsiloxane from Th Goldschmidt and R4046 is an amine blocked p-toluene sulphonic acid catalyst.

Two dye sheet samples (D1 and D2) were prepared by applying dye coat solution, using a K2 Meyer bar to give a dry coat thickness of circa 1.5 μm to two pieces of 23 μm thick polyester film (S grade Melinex from ICI), one of which (D2) had been sputtered with an aluminium layer, thereby forming a reflective subcoat beneath the dye coat.

The receiver coat solution was stirred until all solids were dissolved. Two 20 g batches of solution were removed to one of which 0.06 g of the same absorber material as used in the dye coat were added with further stirring. Three receiver sheet samples (R1, R2 and R3) were prepared by applying the batches of receiver coat solution to three sheets of the same basic material as for the dye coat (is no aluminium layer) using a K3 Meyer bar to give a dry coat thickness of circa 3 μm and cured at 140° C. for 3 minutes. Sample R3 contained the absorber material.

Receiver sheet R1 and dye sheet D1 were held together against an arc to retain laser focus by the application of 1 autosphere pressure. An SDL 150 mw diode laser operating at 807 nm was collimated using a 160 mm achromat lens and projected on to the receiver sheet. The incident laser power was about 100 mw and the full spot size (full width at half power maxima) about 30×20 μm. The laser spot was scanned across the dye sheet by galvanometer to address the laser to locations 20×10 μm apart giving good overlap of adjoining dots. At each location the laser was pulsed for a specific time to build up a block of colour on the receiver. For each receiver, blocks of varying optical density were produced by varying the laser pulse times in increments of 30 μs between 10 and 190 μs inclusively. The optical density of each block was measured using a Sakura densitometer operating in the transmission mode.

The process was repeated for the combination of receiver sheet R2 and dye sheet D2 and receiver sheet R3 and dye sheet D2.

The results in terms of optical density against laser on time for the three combinations are shown by Curves 1, 2 and 3 in FIG. 1.

The improvement seen in the OD build-up between Curves 1 and 2 is due to the reflective subcoat which improves the optical efficiency. The higher OD maximum seen in Curve 2 is due to the fact that the aluminium layer acts as an efficient barrier to diffusion of dye back into the dye sheet substrate.

Curve 3 shows the additional improvement that can be achieved by having absorber material in the receiver sheet.

EXAMPLE 2

This example outlines the influence of changing the position of the reflective layer within the overall media set-up. In the first case, the aluminium sputtered film used in the previous example was coated with the same dye coat, only this time, the dye coat was applied to the free polyester surface of the film so that the reflective layer constituted a back coating. In the second case, a highly reflective layer was placed over the arc before the receiver sheet (type R1) was set up against it so that the reflective layer was not actually an integral part but rather was a part of the printer itself.

Figure 2:
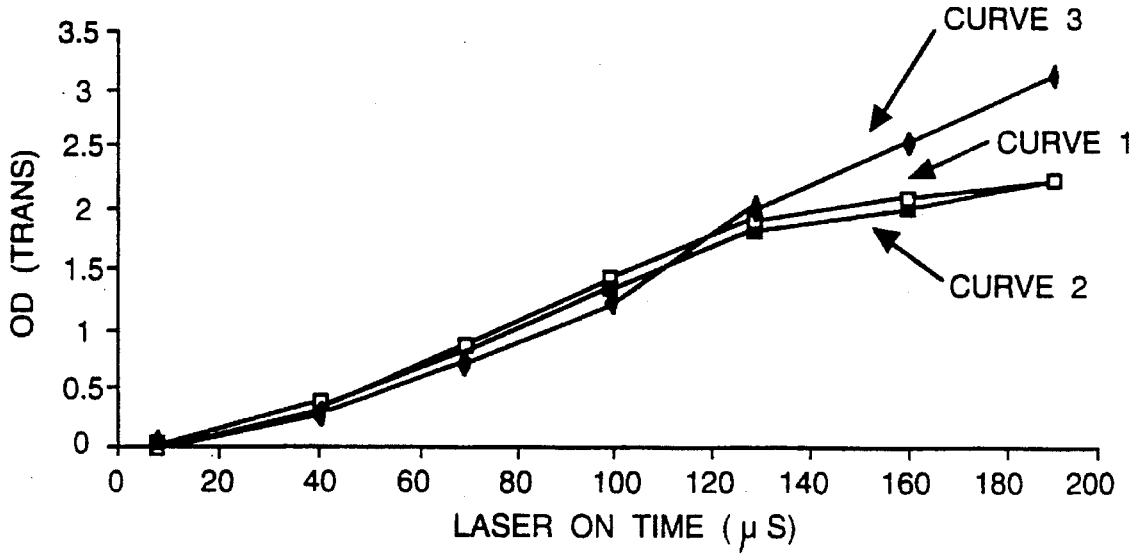

These two configurations were imaged as in the previous example. The OD build up data from the two configurations are compared with the reflective subcoat system in FIG. 2. From the graph, it can be seen that between 0–130 μs, all three configurations build up at roughly the same rate. Above this level, the back diffusion of dye into the dye sheet substrate becomes important and so the rate from the two configurations where the dye coat is applied directly to the dye sheet substrate (Curves 1 & 2) slows up significantly. The configuration with the dye coat applied directly on to the reflective layer (Curve 3) carries on diffusing dye into the receiver sheet only.

We claim:

1. A dye sheet for thermal printing comprising a substrate supporting a dye coat containing one or more dyes transferable in response to thermal stimuli, characterised by the provision in the dye coat or in a separate layer between the dye coat and the substrate of material for absorbing and converting laser light to heat to provide the thermal stimuli and by the provision of a reflective layer positioned such that laser light projected into the dye sheet through the surface of the dye coat and not absorbed on the first pass through the dye coat is reflected back so as to be absorbed on a second pass.

2. A dye sheet according to claim 1, wherein the reflective layer is interposed between the substrate and the dye coat.

3. A dye sheet according to claim 1, wherein the reflective layer is positioned on the opposite face of the substrate to the dye coat.

4. A dye sheet according to any preceding claim, wherein the reflective layer has a reflectance of at least 15%.

5. A dye sheet according to any, of claims 1–3 wherein the reflective layer is aluminum.

6. An assembly for light induced thermal printing comprising a dye sheet comprising a substrate supporting a dye coat containing one or more dyes transferable in response to thermal stimuli and a transparent receiver sheet comprising a substrate supporting a receiver coat containing a material having an affinity for dye molecules, characterized by the provision in the dye coat or in a separate layer between the dye coat and the substrate of material for absorbing and converting laser light to heat to provide the thermal stimuli and of a reflective layer positioned such that when the dye sheet and the receiver sheet are pressed together, laser light projected into the dye sheet through the surface of the dye coat and not absorbed on the first pass through the dye coat is reflected back so as to be absorbed on a second pass.

7. An assembly according to claim 1, in which the receiver sheet contains absorber material.

8. A method of thermal printing comprising positioning a dye sheet in contact with a receiver sheet and projecting laser light into the dye sheet, characterised in that the laser light is projected through the receiver sheet and a reflective layer is positioned in the dye sheet such that laser light not absorbed on the first pass is reflected back so as to be absorbed on a second pass.

9. A method of thermal printing comprising positioning a receiver sheet comprising a substrate supporting a receiver coat containing a material having an affinity for dye molecules in contact with a dye sheet comprising a substrate supporting a reflective layer and, on the reflective layer or on its other surface, a dye coat containing one or more dyes transferable in response to thermal stimuli, and light absorbing material, and applying thermal stimuli, characterised in that the thermal stimuli are produced by projecting a laser through the receiver sheet into the dye coat, where the laser light is absorbed and converted into heat by the absorber material, such that any light not absorbed on the first pass is reflected back so as to be absorbed on a second pass.

10. A dye sheet for thermal printing comprising a substrate supporting a dye coat containing one or more dyes transferable in response to thermal stimuli, characterised by the provision in the dye coat or in a separate layer between the dye coat and the substrate of material for absorbing and converting laser light to heat to provide the thermal stimuli and by the provision of a reflective layer positioned on the opposite face of the substrate to the dye coat such that laser light projected into the dye sheet through the surface of the dye coat and not absorbed on the first pass through the dye coat is reflected back so as to be absorbed on a second pass.

* * * * *